US005997646A

United States Patent [19]

Madrzak et al.

[11] Patent Number: 5,997,646

[45] Date of Patent: Dec. 7, 1999

[54] APPARATUS FOR DIRECT OR INDIRECT APPLICATION OF A LIQUID OR PASTY COATING MEDIUM ONTO A TRAVELING MATERIAL WEB, NOTABLY OF PAPER OR CARDBOARD

[75] Inventors: Zygmunt Madrzak, Heidenheim; Manfred Ueberschaer, Nattheim, both of Germany

[73] Assignee: Voith Sulzer Papiermaschinen GmbH, Heidenheim, Germany

[21] Appl. No.: 08/990,445

[22] Filed: Dec. 15, 1997

[30] Foreign Application Priority Data

Dec. 18, 1996 [DE] Germany ..... 196 52 882

[51] Int. Cl.[6] ..... B05C 3/02

[52] U.S. Cl. ..... 118/413; 118/410; 118/300

[58] Field of Search ..... 118/410, 413, 118/419, 325, 324, DIG. 4, 412, 126

[56] References Cited

U.S. PATENT DOCUMENTS

| | | | |
|---|---|---|---|
| 3,081,191 | 3/1963 | Smith et al. | 118/413 |
| 3,230,928 | 1/1966 | Stalmuke | 118/413 |
| 3,627,564 | 12/1971 | Mercier | 117/69 |
| 4,452,833 | 6/1984 | Holt | 427/356 |
| 4,728,539 | 3/1988 | Gane | 427/356 |
| 5,376,177 | 12/1994 | Eluidge et al. | 118/413 |
| 5,436,030 | 7/1995 | Damrau | 427/240 |

FOREIGN PATENT DOCUMENTS

| | | | |
|---|---|---|---|
| 0 753 357 A1 | 1/1997 | European Pat. Off. | B05C 5/00 |
| 0 761 877 A2 | 11/1997 | European Pat. Off. | D21H 23/46 |
| 41 19 746 A1 | 12/1992 | Germany | B05C 11/04 |
| 295 20 686 U1 | 5/1996 | Germany | B05C 5/02 |
| 296 13 761 U1 | 1/1997 | Germany | B05C 5/02 |
| 2 128 551 | 5/1984 | United Kingdom . | |
| 2 173 131 | 10/1986 | United Kingdom | B05C 3/18 |

*Primary Examiner*—Richard Crispino
*Assistant Examiner*—Calvin Padgett
*Attorney, Agent, or Firm*—Taylor & Associates, P.C.

[57] ABSTRACT

An applicator for direct or indirect application of a liquid or pasty coating medium onto a traveling material web includes a metering system with a metering slot configured as a nozzle and formed between an approach-side lip and a departure-side lip. The applicator also includes, disposed opposite the nozzle, a traveling countersurface on which the coating medium issuing out of the metering slot is to be applied. The exit of the metering slot is followed by a transfer blade for the coating medium, arranged on the approach-side lip. The transfer blade has its length, with respect to the countersurface, selected such that the transfer blade in its operating position contacts the countersurface. The transfer blade passes the coating medium along its departure-side surface from the exit of the metering slot onto the countersurface.

9 Claims, 1 Drawing Sheet

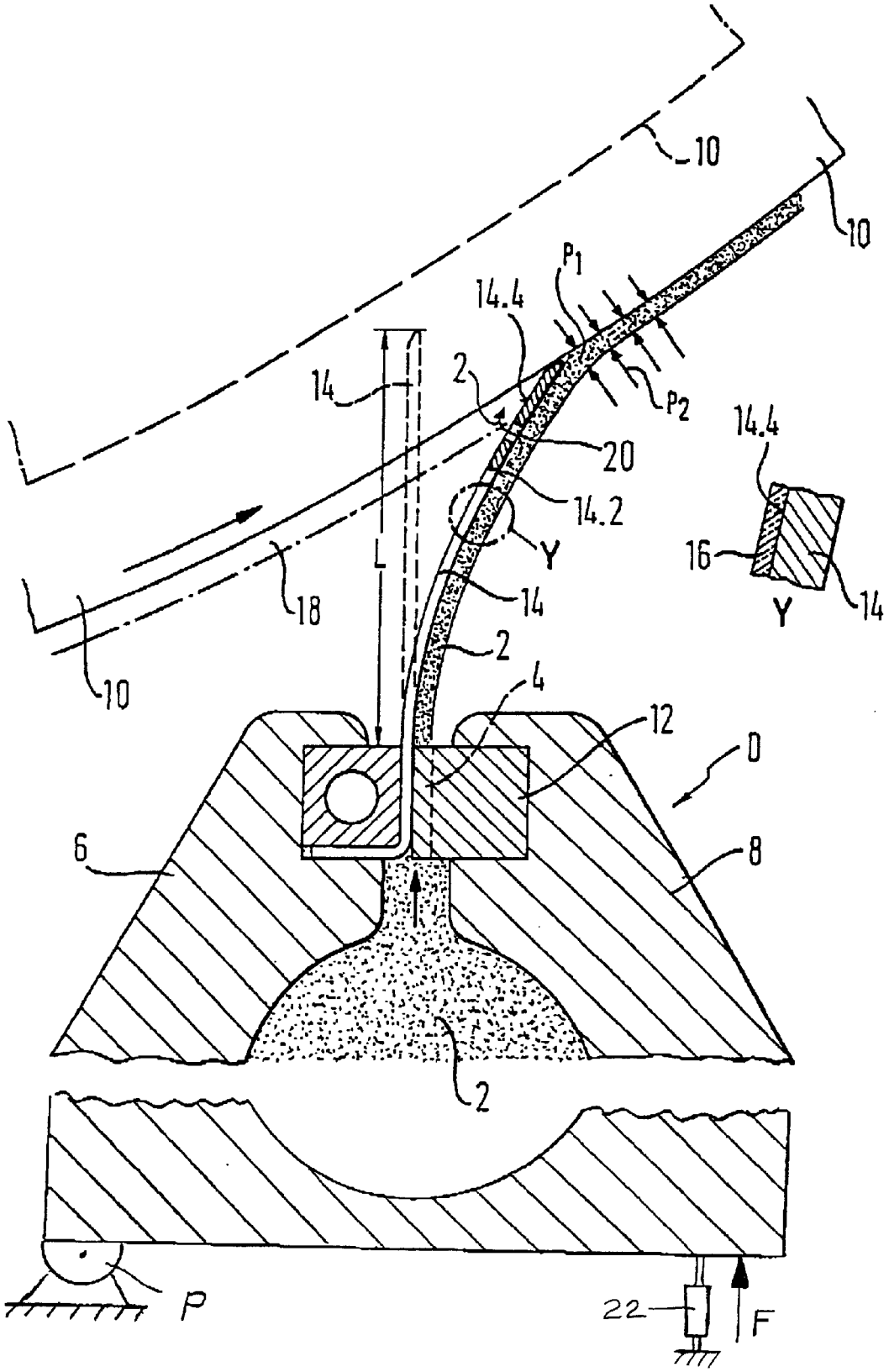
10
10
P1
14.4
14
2
P2
20
14.4
14.2
Y
16
L
14
Y
14
18
2
10
4
12
D
6
8
2
P
22
F

APPARATUS FOR DIRECT OR INDIRECT APPLICATION OF A LIQUID OR PASTY COATING MEDIUM ONTO A TRAVELING MATERIAL WEB, NOTABLY OF PAPER OR CARDBOARD

BACKGROUND OF THE INVENTION

1. Field of the Invention

The present invention relates to an apparatus for direct or indirect application of a liquid or pasty coating medium onto a traveling material web, notably of paper or cardboard.

2. Description of the Related Art

Apparatuses are used in so-called coating systems for providing a traveling material web, formed for example of paper, cardboard or a textile material, on one or both sides with one or several layers of the coating medium, for example color, starch, impregnating fluid or the like.

In the so-called direct application, the liquid or pasty coating medium is applied by an applicator system directly onto the surface of the traveling fiber material web. The web is carried during application on a rotating backing surface, for example an endless belt or a backing roll. In the indirect application of the medium, the liquid or pasty coating medium is first applied onto a substrate, for example the surface of a backing roll configured as an applicator roll. The coating medium is then transferred from the substrate to the fiber material web in a nip through which the fiber material web passes.

Known from German Utility Model No. 295 20 686.1, assigned to the assignee of the present invention, is an applicator for direct application of a liquid or pasty coating medium onto a traveling material web, notably of paper or cardboard. The applicator includes a metering system which is movable from a standby and/or maintenance position to an operating position. The metering system has a metering slot configured as a nozzle and formed between an approach-side lip and a departure-side lip. The applicator also includes a traveling countersurface opposing the nozzle and having the form of an applicator roll or backing roll on which the coating medium issuing out of the metering slot is to be applied. Of the two lips forming the metering slot, the one disposed on the side of the metering slot which in the indirect application of the medium the applicator roll rotates toward, or which in the direct application of the medium the fiber material web runs toward, is called the approach-side lip. Accordingly, the second lip, located on the side of the metering slot from which the applicator roll or fiber material web departs the applicator, is called the departure-side lip. In one embodiment of this applicator, a doctor element, for instance a doctor blade or roll doctor, serves as an applicating doctor and is arranged on the free end of the departure-side lip. The doctor blade or roll doctor scrapes the coating medium, which is applied at surplus, down to a specific coating thickness or a specific profile. In another configuration variant of this applicator, the exit of the metering slot is followed by a concave deflector plate which borders on the approach-side lip and deflects the coating medium issuing out of the metering slot. This metering system is usually followed by a separate doctor element thinning out the coating medium applied on the countersurface.

Known from U.S. Pat. No. 5,436,030, moreover, is an applicator including a concavely curved rigid deflector surface for the liquid or pasty coating medium. The deflector surface borders on the metering slot configured as a nozzle.

In conventional applicators of the type described above, it is necessary to first apply the coating medium at surplus on the traveling countersurface and subsequently scrape it down to a required profile by means of a (mostly separate) doctor element. Resulting therefrom is the use of a relatively large amount of coating medium as well as an appreciable equipment expense along with accordingly increased manufacturing expense and energy demand of the applicator. The increase in energy demand is specifically through higher pump capacity requirements, which, in turn, expresses itself accordingly in the manufacturing and operating costs of these applicators. Besides, backup or backflow phenomena having a negative effect on the coating quality occur at the line of impingement of the coating medium jet on the traveling countersurface, or directly before the doctor element. Furthermore, conventional applicators involve undesirable boundary layer phenomena. For instance, the coating medium makes, on account of the previously illustrated applicator design, direct contact with the boundary layer of air entrained by the traveling countersurface. This leads to air inclusions in the coating medium and a quality reduction of the produced coating. Also, the bent or angled deflector plates or the specially configured nozzle lips with molded, rigid deflection surfaces, such as used in prior applicators, are relatively expensive to fabricate and, consequently, high in cost.

The present invention provides an improved applicator such that the disadvantages associated with the prior art, notably the described boundary layer phenomena, will be avoided easily and to maximum extent. The present invention also provides an improved applicator for the production of a high-quality coating.

SUMMARY OF THE INVENTION

This applicator for direct or indirect application of a liquid or pasty coating medium onto a traveling material web, notably of paper or cardboard, includes a metering system which is movable from a standby position and/or maintenance position to an operating position. The metering system has a metering slot that is configured as a nozzle and is formed between an approach-side lip and a departure-side lip. The applicator also includes a traveling countersurface which is disposed opposite the nozzle and on which the coating medium issuing out of the metering slot is to be applied. The exit of the metering slot is followed by a transfer blade for the coating medium, arranged on the approach-side lip. The length of the transfer blade relative to the countersurface is selected such that the transfer blade in its operating position makes contact with the countersurface, The transfer blade channels the coating along the departure-side surface of the transfer blade, from the exit of the metering slot onto the countersurface. Thus, the transfer blade sweeps across the traveling countersurface in the operation of the applicator. Sweeping across the countersurface at a certain pressure, the transfer blade with its approach-side blade surface strips the boundary layer of air entrained by the countersurface. At the same time, the transfer blade, with its directly adjacent, departure-side blade surface, passes the coating medium from the metering slot exit onto the countersurface, which now is free of a boundary layer of air. The influence of negative boundary layer phenomena can thus be effectively eliminated. Improved, moreover, is the color anchoring of the coating medium on the countersurface, since stripping the boundary layer causes the buildup of a pressure lower than atmospheric ambient pressure on the departure-side tip of the transfer blade. The coating medium is thus drawn by the transfer blade surface onto the countersurface and, at the same time, pressed onto or into the countersurface by the ambient pressure. Additionally, a smoothing and longitudinal orientation of the traveling countersurface is taking place, which, particularly in the direct application, has a positive effect on the coating quality achieved. Besides, the inventional applicator may allow an application of the coating medium without surplus, that is, the coating medium, once applied, can remain entirely on the coated surface without necessarily requiring a subsequent downscraping of the produced coating. The amount of coating medium to be applied onto the countersurface for the production of a high quality coating may thus be reduced. This reduction is due to the particular transfer blade that combines the functions of a modified nozzle, a guide surface, a boundary layer manipulating system and a leveling system. In turn, this enables a reduction of the necessary energy demand of the applicator, notably of the pumping systems. This also allows a more compact design of both the metering system and the entire applicator, which is conducive to lowering the cost of production, operation and maintenance. Besides, the inventional applicator can be employed for the production of a multilayer coating in the so-called wet-in-wet mode of operation. Lastly, nearly any known nozzle applicator can be retrofitted easily and without great expense to the applicator configuration according to the invention.

The transfer blade is configured as an elastically deformable transfer blade. In its operating position, such transfer blade makes contact with the countersurface in an elastically deformed, i.e., elastically bent state. The transfer blade passes the coating medium along its departure-side surface from the metering slot exit onto the countersurface. Sweeping across the traveling countersurface, the elastic transfer blade assumes in the process a shape with a substantially concave curvature. The tip of the transfer blade points substantially in the direction of travel of the countersurface, that is, in the direction of travel of the applicator roll or of the fiber material web carried by the backing surface. With the concave flexure of the elastic transfer blade, the transfer blade assumes at the same time the function of a deflector surface. Due to the flexure, the effects known already from conventional, but comparatively more involved and more expensive deflector surfaces may also be utilized for removal of air inclusions contained in the coating medium exiting from the metering slot. Varying the pressure acting on the transfer blade, and thus varying the transfer blade geometry, allows a manipulation of the angle of deflection and angle of impingement of the coating medium on the countersurface.

According to a configuration feature of the applicator according to the invention, the transfer blade is equipped, at least on its approach-side blade surface that is in contact with the countersurface, with a wear guard. The wear guard prolongs the service life and enhances the form stability of the transfer blade, thereby contributing indirectly to a uniform coating on the departure-side transfer blade surface. A ceramic coating has proved to be a particularly suitable wear guard. However, the invention is not geared exclusively to this coating. Other wear protection measures on the transfer blade may be taken as well. For example, the entire transfer blade or parts thereof may be made of a particularly wear-resistant material.

The transfer blade can include one or more apertures in the area of its tip coordinated with the countersurface. These apertures allow the coating medium flowing along the departure-side surface of the transfer blade toward the countersurface to proceed to an approach-side area of the transfer blade. On the approach-side, the coating medium both prewets the countersurface and serves at the same time as lubrication for the tip area of the transfer blade. The lubrication function also contributes to a wear reduction of the transfer blade.

In a further embodiment of the invention, the applicator includes at least one pressure system for elastically deforming the transfer blade and/or pressing the transfer blade down onto the traveling countersurface. The pressure system, e.g., may be a pressure bar acted upon by actuators. The pressure bar acts evenly across substantially the entire machine width or zonewise differently on the transfer blade through the metering system, deforming the transfer blade accordingly and pressing it onto the countersurface. As needed, the pressure system may thus assume the functions for manipulation of the transfer blade which result normally from a method of adjustment of the metering system from a standby position and/or maintenance position to an operating position.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawing, which is a schematic, side, cross-sectional view of one embodiment of an inventional applicator in the area of a metering system.

The exemplification set out herein illustrates one preferred embodiment of the invention, in one form, and such exemplification is not to be construed as limiting the scope of the invention in any manner.

DETAILED DESCRIPTION OF THE INVENTION

As follows from the FIGURE, the inventional applicator, configured in the embodiment shown as an applicator for indirect application of a liquid or pasty coating medium 2 onto a traveling material web, notably of paper or cardboard, includes a metering system D. Metering system D is retained on a not illustrated oblong support element and is movable from a standby and/or maintenance position to an operating position by using an actuator 22 to rotate metering system D about a pivot P. Metering system D has a nozzle, i.e., more exactly a metering slot 4 configured as an open-jet nozzle. Metering slot 4 is formed between an approach-side lip 6 and a departure-side lip 8 which are arranged so as to be movable toward and away from each other. Disposed opposite metering system D is an applicator roll 10 serving as a substrate. The direction of rotation of roll 10 is indicated by an arrow. The coating medium is transferred from applicator roll 10 to the fiber material web in a not illustrated nip, through which the fiber material web passes.

Mounted in departure-side lip 8 of metering system D is a profile bar 12 with a plurality of defined comb-like or sawtooth-like through slots, which together form the aperture of metering slot 4. Made of a thin, elastic, straight plate, an oblong transfer blade 14 includes in the area of its tip coordinated with countersurface 10 several through openings or apertures 20. Transfer blade 14 is detachably clamped between approach-side lip 6 and profile bar 12 in a way such that the side of profile bar 12 containing the through slots rests flush on a bottom section of transfer blade 14. The bottom section of transfer blade surface 14.2 forms a sidewall of metering slot 4. The unstressed transfer blade 14 has in the standby and/or maintenance position of metering system D the basic shape illustrated in the drawing by dashed lines.

The metering system D is, in the operation of the applicator, moved or pivoted to its operating position. A pressure system includes actuator 22 rotating metering system D about pivot P with an upwards force F. The pressure system elastically deforms or presses transfer blade 14 onto applicator roll 10. Transfer blade 14, featuring on the tip of its distal end a chamfer, is pressed onto the rotating applicator roll 10. The length L of transfer blade 14 is so selected, in relation to applicator roll 10 and depending on the required adjustment path of metering system D, that transfer blade 14 rests, in the operating position illustrated by solid lines, in an elastically deformed state on applicator roll 10. Transfer blade 14 thus assumes a concave curvature. The mode of operation of blade 14 is described as bent-blade mode of operation. The tip of transfer blade 14 points substantially in the running direction of applicator roll 10. According to the enlarged section Y in the drawing, transfer blade 14 is on its approach-side blade surface 14.4, i.e., the one making contact with applicator roll 10, equipped with a ceramic coating 16 serving as a wear guard.

As can be seen from the FIGURE, transfer blade 14, sliding with a certain pressure over applicator roll 10, strips with its approach-side blade surface 14.4 the boundary air layer 18 entrained by applicator roll 10. At the same time, blade 14 passes, on its directly adjacent departure-side blade surface 14.2, the coating medium 2 issuing out of metering slot 4 onto the surface of applicator roll 10 that is now free of a boundary layer. The application of coating medium 2 occurs here without surplus. The pressure conditions occasioned in the vicinity of the departure-side tip of transfer blade 14, due to stripping the boundary air layer 18, are referenced $P_1$ and $P_2$ in the drawing. $P_2$ represents the atmospheric ambient pressure and $P_1$ represents the local pressure, which is lower than the ambient pressure, directly on the departure-side blade tip. The locally lower pressure $P_1$ causes coating medium 2 to be drawn by the transfer blade surface 14.2 onto applicator roll 10. The atmospheric ambient pressure $P_2$, at the same time, presses coating medium 2 onto applicator roll 10. This results in an improved anchoring or adhesion on applicator roll 10.

A small portion of coating medium 2 flowing along the departure-side surface 14.2 to countersurface 10 passes through apertures 20 provided in the area of the tip of the distal end of transfer blade 14 coordinated with countersurface 10. Coating medium 2 thus proceeds to an approach-side area of transfer blade 14 and causes there both a certain prewetting of countersurface 10 and a lubrication of the transfer blade tip.

The invention is not limited to the above exemplary embodiments, which serve merely the general illustration of the basic idea of the invention. Rather, the inventional applicator may within the scope of protection also assume configurations other than those described above. The applicator may notably possess features that represent a combination of the respective individual features. Besides the previously described clamping of transfer blade 14 between approach-side lip 6 and departure-side lip 8, other suitable ways of fastening are also possible, e.g., screwing transfer blade 14 to approach-side lip 6 or the like. Furthermore, transfer blade 14 may possess in its unstressed state a preformed curvature. In the operating position, wherein transfer blade 14 rests on countersurface 10, the preformed curvature is further augmented by the elastic bending of transfer blade 14.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An applicator for application of a coating medium onto a traveling fiber material web, said applicator comprising:

a traveling countersurface configured for one of receiving the medium in the indirect application and carrying the fiber material web in the direct application;

a metering system including an approach-side lip and a departure-side lip defining a metering slot therebetween, said departure-side lip being disposed after said approach-side lip relative to a direction of travel of said countersurface, said metering slot being configured as an open-jet nozzle, said metering slot having an exit for jetting the coating medium which is disposed opposite said traveling countersurface; and a transfer blade attached to said approach-side lip, said transfer blade disposed between said approach-side lip and said departure-side lip, said transfer blade extending out of said metering slot exit, said transfer blade including an approach-side surface contacting said traveling countersurface, said transfer blade including a departure-side surface disposed after said approach-side surface relative to said direction of travel of said countersurface, said transfer blade being configured for passing the coating medium jetted from said metering slot along said departure-side surface from said metering slot exit onto said countersurface.

2. The applicator of claim 1, wherein said transfer blade comprises an elastically deformable transfer blade.

3. The applicator of claim 1, wherein said approach-side surface of said transfer blade has a wear guard.

4. The applicator of claim 3, wherein said wear guard comprises a ceramic coating.

5. The applicator of claim 1, wherein said transfer blade includes a distal end associated with said countersurface, said distal end having at least one through opening.

6. The applicator of claim 1, further comprising at least one pressure system for at least one of elastically deforming said transfer blade and pressing said transfer blade onto said traveling countersurface.

7. The applicator of claim 1, wherein said departure-side lip includes a profile bar mounted therein, said profile bar having a side with a plurality of comb-like through slots, said side of said profile bar abutting said transfer blade such that an aperture of said metering slot is defined therebetween.

8. The applicator of claim 7, wherein said transfer blade is detachably clamped between said approach-side lip and said side of said profile bar.

9. The applicator of claim 1, wherein said countersurface and said approach-side surface of said transfer blade define an open-air gore therebetween.

* * * * *